US011015364B2

(12) United States Patent
DeGidio

(10) Patent No.: US 11,015,364 B2
(45) Date of Patent: May 25, 2021

(54) LOCKING TENT STAKE AND METHOD OF USE

(71) Applicant: Joseph Todd DeGidio, Kemah, TX (US)

(72) Inventor: Joseph Todd DeGidio, Kemah, TX (US)

( * ) Notice: Subject to any disclaimer, the term of this patent is extended or adjusted under 35 U.S.C. 154(b) by 0 days.

(21) Appl. No.: 16/786,426

(22) Filed: Feb. 10, 2020

(65) Prior Publication Data

US 2020/0256084 A1 Aug. 13, 2020

Related U.S. Application Data

(60) Provisional application No. 62/803,146, filed on Feb. 8, 2019.

(51) Int. Cl.
*E04H 15/62* (2006.01)
*E02D 5/80* (2006.01)

(52) U.S. Cl.
CPC ..... *E04H 15/62* (2013.01); *E02D 5/803* (2013.01)

(58) Field of Classification Search
CPC ..... E04H 15/62; E02D 5/80; E02D 5/803
See application file for complete search history.

(56) References Cited

U.S. PATENT DOCUMENTS 697,031 A * 4/1902 Snook ..... E02D 5/803 52/160
707,683 A * 8/1902 Farwell ..... E02D 5/803 52/160
727,335 A * 5/1903 Fisher ..... E02D 5/803 52/160
1,189,787 A * 7/1916 Caddy ..... E02D 5/803 52/160
1,796,147 A * 3/1931 Green ..... E02D 5/803 52/161
1,805,084 A * 5/1931 Gianini ..... E04H 15/62 52/161
1,940,439 A * 12/1933 Alleman ..... C10L 1/306 44/454
2,431,608 A * 11/1947 Clapper ..... E02D 5/803 52/161
2,431,609 A * 11/1947 Clapper ..... E02D 5/803 52/161
2,863,535 A * 12/1958 Clapper ..... E02D 5/803 52/161
2,966,243 A * 12/1960 Clapper ..... E02D 5/803 52/161

(Continued)

*Primary Examiner* — David R Dunn
*Assistant Examiner* — Danielle Jackson
(74) *Attorney, Agent, or Firm* — Blanchard & Associates

(57) ABSTRACT

A locking tent stake comprises an elongate sleeve defining a hollow interior, an opening at a rearward end of the sleeve, and a slot extending along an axial dimension of a forward portion of the sleeve, the slot providing external access to a forward end of the interior of the sleeve. A pin is receivable within the rearward opening along a length of the interior of the sleeve. The pin comprises an elongate shaft having a retractable barb rotatably secured to a forward end thereof, the barb being rotatable between a first position, in which the barb is received within a recess along the length of the shaft, and a second position, in which the barb is extended forward of the forward end of the shaft.

20 Claims, 9 Drawing Sheets

(56) References Cited

U.S. PATENT DOCUMENTS

| | | | | | |
|---|---|---|---|---|---|
| 3,512,319 | A * | 5/1970 | Piacentino | E02D 5/803 | 52/160 |
| 5,010,698 | A * | 4/1991 | Hugron | E02D 5/805 | 135/118 |
| 5,217,194 | A * | 6/1993 | Brownell | A63G 9/00 | 135/118 |
| 5,245,715 | A * | 9/1993 | Dinkins | E04H 15/62 | 135/118 |
| 5,623,843 | A * | 4/1997 | Sands | B62H 3/00 | 248/499 |
| 9,822,546 | B1 * | 11/2017 | Durham | E04H 15/62 | |

* cited by examiner

LOCKING TENT STAKE AND METHOD OF USE

CROSS-REFERENCE TO RELATED APPLICATIONS

This application claims the benefit of U.S. Provisional Patent Application Ser. No. 62/803,146, filed on Feb. 8, 2019, which is incorporated herein in its entirety by reference.

FIELD OF INVENTION

The present general inventive concept relates to tent stakes for use in securing tent structures, and, more particularly, to a tent stake having a locking feature for securing the tent stake to a supporting surface.

BACKGROUND

Assembly of tents, canopies, and other such structures (generally referred to herein as "tents") often includes using stakes, pegs, or the like (generally referred to herein as "stakes") to anchor the tent to a support surface, such as the ground. Tent stakes are typically constructed as elongated, spike-like structures, and are often fabricated of metal, wood, plastic, composite material, or the like. Typically, tent stakes are constructed to be driven into the ground and attached to a component of the tent, such as for example ropes or cords attached to the tent, loops of fabric or metal gussets incorporated into the body of the tent, etc., such that the tent stake serves to pin or otherwise frictionally secure the tent to the ground.

Various prior art designs for tent stakes are prone to inadvertent slippage in relation to the portion of the ground surface into which the stake is driven, and such situations can result in undesirable movement, and in some circumstances catastrophic collapse, of the corresponding tent. For example, in particularly windy conditions, it is often possible for a tent to be pushed by the wind with sufficient force to pull one or more of the tent's stakes out from the ground. Likewise, in the event an object, such as a tree branch, a leg of a person or animal, etc., contacts or becomes entangled in one of the ropes connecting a tent stake to a tent, it is possible for the tent stake to be pulled from the ground. In such situations, the tent may become at least partially unsecured from the ground, such that the tent may more easily be overturned and/or may collapse.

In view of the above, there is a desire for a tent stake that is capable of being driven into and positively secured to a ground surface, such that the tent stake is less prone to inadvertent removal.

BRIEF SUMMARY

According to various example embodiments of the present general inventive concept, a locking tent stake is provided that is configured to be driven into and positively secured to a ground surface. Example embodiments of the lockable tent stake are configured with a retractable barb that may be deployed to more securely hold the tent stake in place in the ground, such that the tent stake is limited from inadvertent removal from the ground surface.

Additional aspects and advantages of the present general inventive concept will be set forth in part in the description which follows, and, in part, will be obvious from the description, or may be learned by practice of the present general inventive concept.

The foregoing and/or other aspects and advantages of the present general inventive concept may be achieved by providing a locking tent stake including an elongate sleeve defining a hollow interior, an opening at a rearward end of the sleeve, and a slot extending along an axial dimension of a forward portion of the sleeve, the slot providing external access to a forward end of the interior of the sleeve, and a pin configured to be receivable within the rearward opening along a length of the interior of the sleeve, the pin comprising an elongate shaft having a retractable barb rotatably secured to a forward end thereof, the barb being rotatable between a first position, in which the barb is received within a recess along the length of the shaft, and a second position, in which the barb is extended forward of the forward end of the shaft, wherein when the barb is extended forward of the forward end of the shaft and the shaft is inserted along the interior of the sleeve, the barb is urged outward from the sleeve interior through the slot.

The foregoing and/or other aspects and advantages of the present general inventive concept may also be achieved by providing a locking tent stake including a first elongate member configured with a pointed first end, a hollow shaft extending from an opening formed in a second end, and a through slot formed in an exterior of the first elongate member proximate the first end, a second elongate member configured to be selectively inserted into, and removed from, the hollow shaft of the first elongate member, a retractable barb pivotally coupled to a first end of the second elongate member and configured to be selectively rotated between a back position retracted into the second elongate member and a forward position extending away from the first end of the second elongate member, wherein the retractable barb is guided through the through slot of the first elongate member when the second elongate member is inserted into the second elongate member with the retractable barb extended to the forward position.

The foregoing and/or other aspects and advantages of the present general inventive concept may also be achieved by providing a method of establishing a secure connection with a ground surface, the method including providing an elongate sleeve defining a hollow interior, an opening at a rearward end of the sleeve, and a slot extending along an axial dimension of a forward portion of the sleeve, the slot providing external access to a forward end of the interior of the sleeve, providing a pin receivable within the rearward opening along a length of the interior of the sleeve, the pin comprising an elongate shaft having a retractable barb rotatably secured to a forward end thereof, the barb being rotatable between a first position, in which the barb is received within a recess along the length of the shaft, and a second position, in which the barb is extended forward of the forward end of the shaft, inserting the pin into the sleeve interior with the barb in the first position, driving the pin and sleeve into the ground surface, removing the pin from the sleeve and rotating the barb to the second position, and re-inserting the pin into the sleeve interior, whereby the barb is urged outward from the sleeve interior through the slot.

Other features and aspects may be apparent from the following detailed description, the drawings, and the claims.

BRIEF DESCRIPTION OF THE FIGURES

The following example embodiments are representative of example techniques and structures designed to carry out the objects of the present general inventive concept, but the present general inventive concept is not limited to these example embodiments. In the accompanying drawings and illustrations, the sizes and relative sizes, shapes, and qualities of lines, entities, and regions may be exaggerated for clarity. A wide variety of additional embodiments will be more readily understood and appreciated through the following detailed description of the example embodiments, with reference to the accompanying drawings in which.

DETAILED DESCRIPTION

Figure 1:
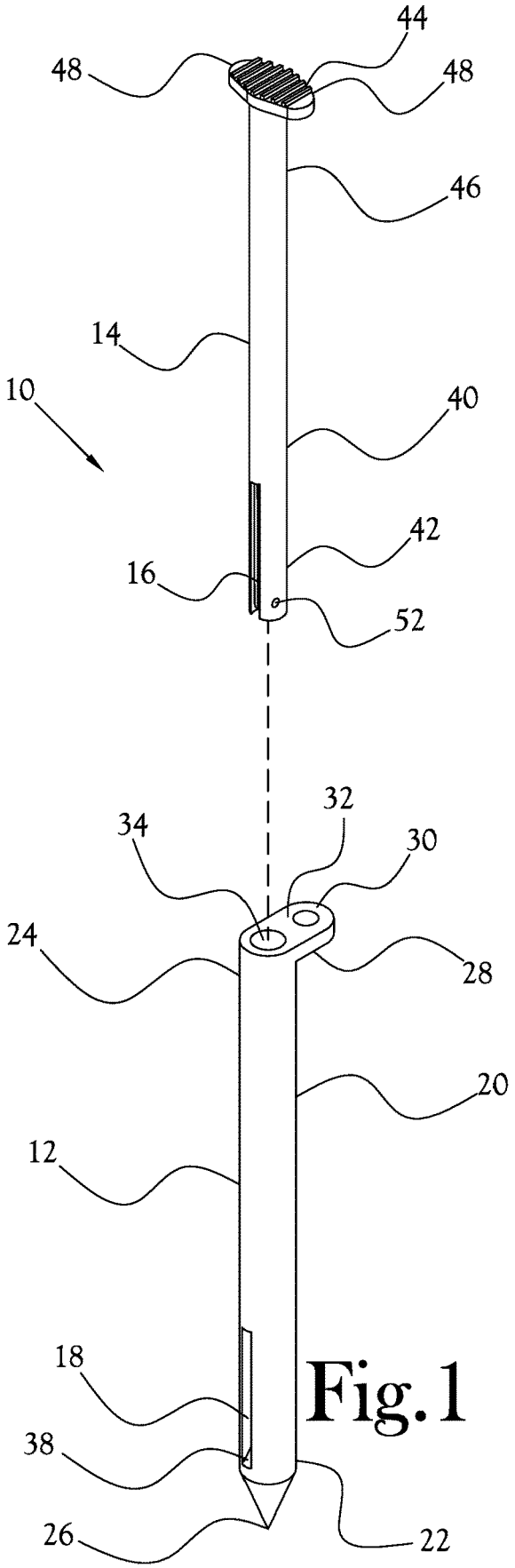
FIG. 1 illustrates a partially exploded perspective view of one embodiment of a locking tent stake constructed in accordance with several features of the present general inventive concept.

Reference will now be made to the example embodiments of the present general inventive concept, examples of which are illustrated in the accompanying drawings and illustrations. The example embodiments are described herein in order to explain the present general inventive concept by referring to the figures.

The following detailed description is provided to assist the reader in gaining a comprehensive understanding of the structures and fabrication techniques described herein. Accordingly, various changes, modification, and equivalents of the structures and fabrication techniques described herein will be suggested to those of ordinary skill in the art. The progression of fabrication operations described are merely examples, however, and the sequence type of operations is not limited to that set forth herein and may be changed as is known in the art, with the exception of operations necessarily occurring in a certain order. Also, description of well-known functions and constructions may be simplified and/or omitted for increased clarity and conciseness.

Note that spatially relative terms, such as "up," "down," "right," "left," "beneath," "below," "lower," "above," "upper" and the like, may be used herein for ease of description to describe one element or feature's relationship to another element(s) or feature(s) as illustrated in the figures. Spatially relative terms are intended to encompass different orientations of the device in use or operation in addition to the orientation depicted in the figures. For example, if the device in the figures is turned over or rotated, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

According to various example embodiments of the present general inventive concept, a locking tent stake is provided that is configured to be driven into and positively secured to a ground surface. Example embodiments of the lockable tent stake are configured with a retractable barb that may be deployed to more securely hold the tent stake in place in the ground, such that the tent stake is limited from inadvertent removal from the ground surface. In various example embodiments of the present general inventive concept, a locking tent stake includes a lower member that is configured to accept an upper member therein, the upper member having a retractable barb that is positionable to be selectively contained substantially within the body of the upper member when the upper member is disposed inside the lower member, or to extend from both the upper and lower members when the upper member is disposed inside the lower member. The upper member may be placed inside the lower member with the barb retracted so that the locking tent stake can be driven into the ground. Once in the ground, the upper member can be slide out while the lower member remains in the ground, and the retractable barb can be repositioned to extend from the body of the upper member. The upper member is then slid back into the lower member, and the inner configuration of the lower member causes the retractable barb at the distal end of the upper member to be moved out of an opening in the distal end of the lower member to be forced out into the ground at an angle away from that of the upper and lower members of the tent stake, thus creating an anchoring, or locking, barb for the tent stake.

Figure 2:
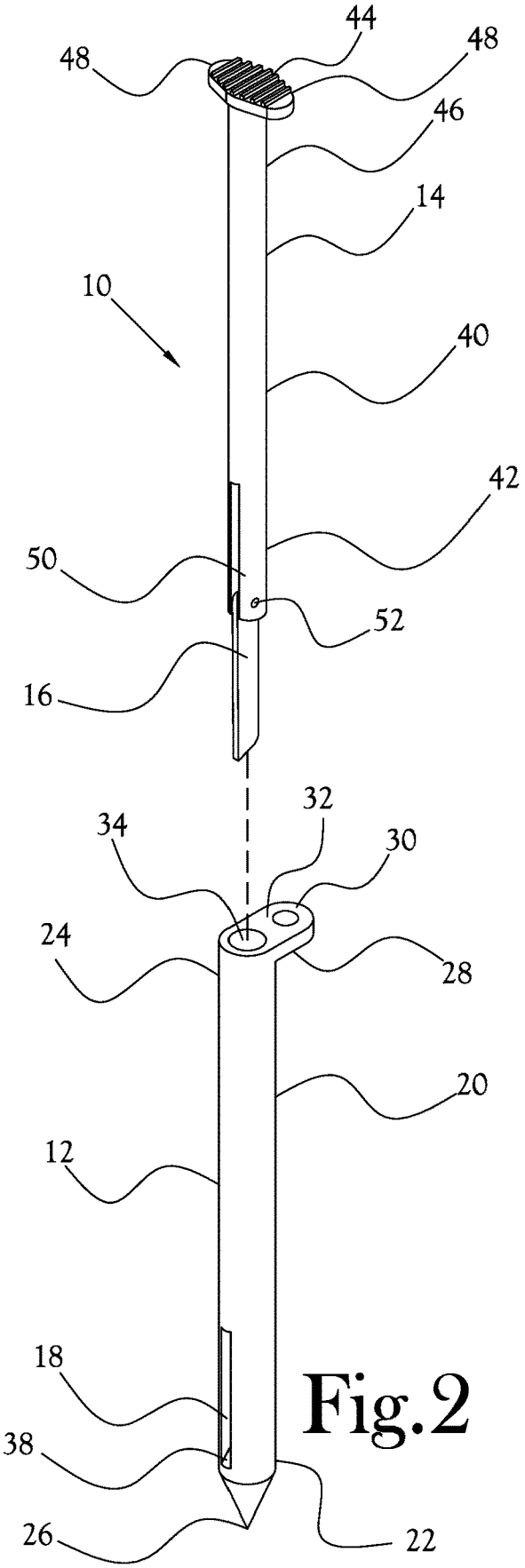
FIG. 2 illustrates a partially exploded perspective view of another configuration of the locking tent stake of FIG. 1.

FIG. 1 illustrates a partially exploded perspective view of one embodiment of a locking tent stake constructed in accordance with several features of the present general inventive concept, and FIG. 2 illustrates a partially exploded perspective view of another configuration of the locking tent stake of FIG. 1. As illustrated in FIGS. 1-2, a locking tent stake 10 includes generally an elongate lower member, or outer sleeve, 12 and an elongate upper member, or central pin, 14 configured to be receivable along a length of the interior of the outer sleeve 12. The central pin 14 is configured to be received within the outer sleeve 12, such that the combination thereof may be driven into a support surface, such as, for example, a ground surface. As will be described in further detail hereinbelow, a retractable barb 16 is rotatably secured to the pin 14 proximate a distal end thereof, and is receivable through a slot 18 along the length of the sleeve 12, such that, once the sleeve 12 is driven into the surface, the barb 16 may be deployed to secure the stake 10 within the surface and to discourage removal of the stake 10 from the surface. In the example embodiment illustrated in FIGS. 1-2, the outer sleeve 12 is configured with a substantially elongate, hollow shaft 20 having a closed leading end 22 and an opposite open trailing end 24. The leading end 22 defines a point 26 protruding substantially along a central axis of the shaft 20, such that the leading end 22 may be driven into, for example, a ground surface. In various embodiments, the trailing end 24 defines at least one fastening member or mechanism to allow the sleeve 12 to be secured to a rope, cord, fabric loop, or other tent structure. For example, in the illustrated embodiment, the trailing end 24 defines a flange 28 extending outwardly from the sleeve trailing end 24 and perpendicular to the axial dimension of the sleeve 12. The flange 28 defines a through opening 30 therein, such that a rope or other such securing member may be inserted through the through opening 30 and tied, thereby securing the rope to the flange 28. Additionally, in the illustrated embodiment, the flange 28 cooperates with the trailing end 24 of the sleeve 12 to define a relatively flat rear surface 32 of the sleeve 12, extending generally perpendicular to the axial dimension of the sleeve 12.

As discussed above, the sleeve 12 further defines an elongate interior 34 extending from the flat rear surface 32 of the sleeve along the axial dimension of the sleeve 12. In various embodiments, the sleeve 12 further defines a through slot 18 formed along an axial dimension of the sleeve 12, rearward of the point 26. In the illustrated embodiment, a forward end of the sleeve interior 34 and a forward surface of the slot 18 cooperate to define a ramp surface 38 extending outwardly and forwardly from the forward end of the sleeve interior 34 to the forward-most end of the slot 18, exterior of the sleeve 12. In this manner, an object may be received within the elongate interior 34 opening in the flat rear surface 32 of the sleeve and may pass forward along the sleeve interior 34 before being directed by the ramp surface 38 outward from the sleeve interior through the slot 18. In various example embodiments, the central pin 14 defines a shaft portion 40 which is sized and shaped to be received along the length of the sleeve interior 34, within the sleeve interior 34, and a rearward flange 44 which extends outwardly from the trailing end 46 of the shaft 40, perpendicular to the axial dimension of the shaft 40. In various example embodiments, the flange 44 of the pin 14 is sized and shaped to overlie in a mating relationship with the flange 28 of the outer sleeve 12, such that when the pin 14 is received within the sleeve interior, the flange 44 of the pin 14 provides a bearing surface upon which a driving force, such as an impact force from a hammer, may be applied, thereby allowing both the pin 14 and sleeve 12 to be driven forward along the co-axis thereof. In the illustrated embodiment, the flange 44 of the pin 14 defines a pair of oppositely-disposed wings 48 which protrude slightly outward beyond the flange 28 of the sleeve 12, thereby providing convenient means for gripping the flange 44 of the pin 14 to facilitate withdrawal and repositioning of the pin 14 from within the interior of the sleeve 12. Additionally, in the illustrated embodiment, the flange 44 defines a plurality of grooves along an outer surface thereof which form a textured surface to assist in gripping the flange 44, and also to assist in receiving the above-discussed driving force and to limit slippage of tooling impacting the flange 44. Various example embodiments may provide a variety of other configurations of a rearward flange, or other portions of the locking tent stake 10, without departing from the scope of the present general inventive concept. In another example embodiment, the flange 44 of the pin 14 may define a through opening 36 (illustrated later in FIGS. 16A and 16C) configured to overlie the through opening 30 of the flange 28 of the sleeve 12. In such an example embodiment, a rope may be inserted and tied through both through openings in the respective flanges 28, 44, thereby securing the flanges 28, 44 to one another, while simultaneously securing the rope to the flanges 28, 44.

In the illustrated embodiment, a forward portion 42 of the pin 14 defines a slotted recess 50 disposed along a length thereof such that, when the pin 14 is fully received within the sleeve 12, the recess 50 aligns in parallel, underlying relationship to the slot 18 of the sleeve 12. More specifically, in the illustrated embodiment, the recess 50 opens along the exterior of the shaft 40 from a forward-most portion of the shaft 40 along a partial length thereof, and also opens to a forward end of the shaft 40. As mentioned above, a retractable barb 16 is provided, comprising a substantially rigid member sized and shaped to be received within the recess 50. The barb 16 is rotatably secured at a first end thereof proximate the forward end of the shaft 40 via a pin connector 52. The second end of the barb 16 is rotatable in relation to the shaft 40 between a first position, in which the barb 16 is fully received within the recess 50, and a second position, in which the second end of the barb 16 is extended forward of the shaft 40 with the barb 16 in parallel, coaxial relationship with the shaft 40.

Figure 3:
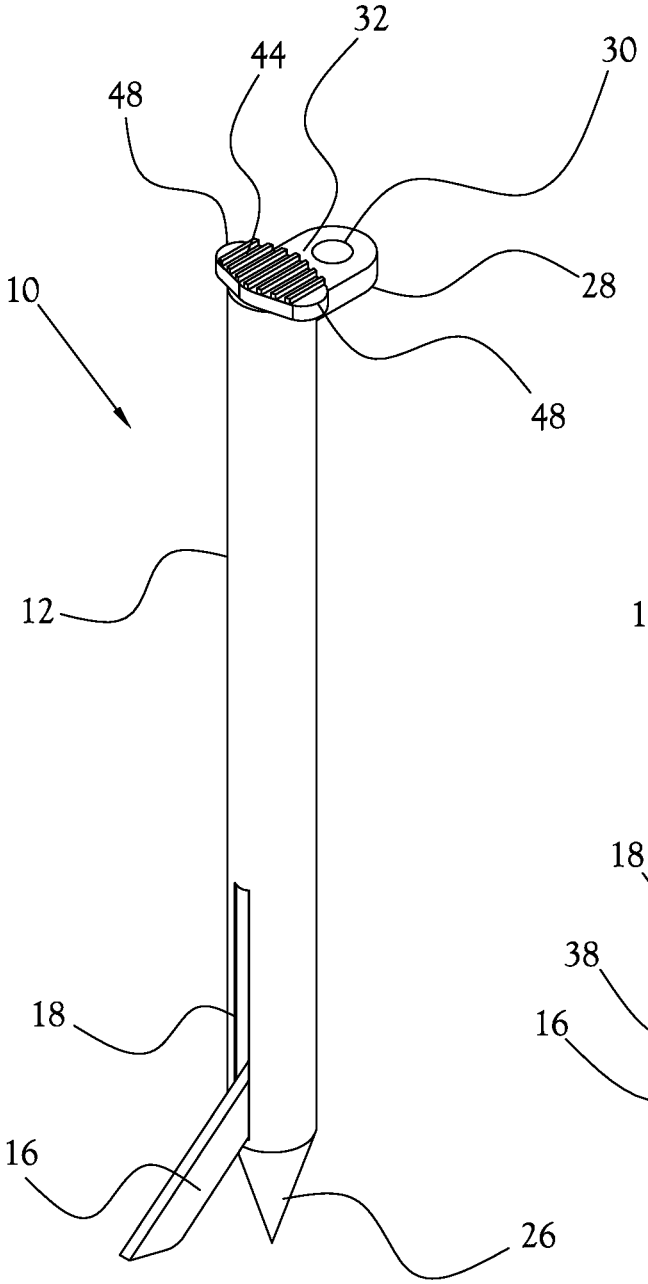
FIG. 3 illustrates a perspective view of the locking tent stake of FIG. 1 in an assembled state.
Figure 4:
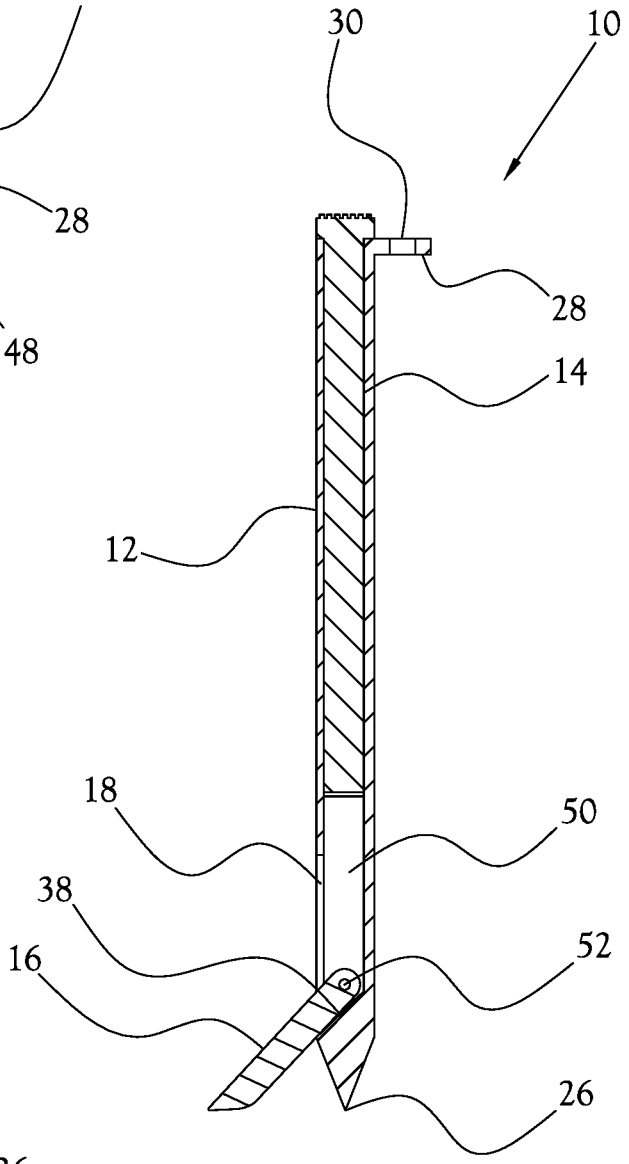
FIG. 4 illustrates a cross-sectional side view of the locking tent stake of FIG. 1 in an assembled state.

In various example embodiments, the barb 16 is further sized and shaped such that it may be received through the slot 18 in the sleeve 12, and more specifically, such that when barb 16 is extended forward of the shaft 40 with the barb 16 in parallel, coaxial relationship with the shaft 40, and when the shaft 40 is thereafter inserted into the sleeve interior 34, the ramp surface 38 urges the barb 16 to rotate outwardly from the sleeve 12 through the slot 18. FIG. 3 illustrates a perspective view of the locking tent stake 10 of FIG. 1 in an assembled state with the retractable barb 16 deployed, and FIG. 4 illustrates a cross-sectional side view of the locking tent stake 10 the same assembled state. Thus, when the central pin 14 is inserted into the elongate interior 34 of the outer sleeve 12 with the rectractable barb 16 extended forward from the forward portion 42 of the central pin 14, as the forward end of the retractable barb 16 contacts the ramp surface 38 of the sleeve interior 34 the retractable barb 16 is urged outward through the through slot 18 of the outer sleeve 12. When the central pin 14 is pushed through to the point where the rearward flange 44 abuts the flat rear surface 32 of the flange 28 of the outer sleeve 12, the retractable barb 16 has been rotated so as to point forward and angled away from the outer sleeve 12 to form an anchoring or barbed portion to help maintain the deployed locking tent stake 10 in the ground.

Figure 5:
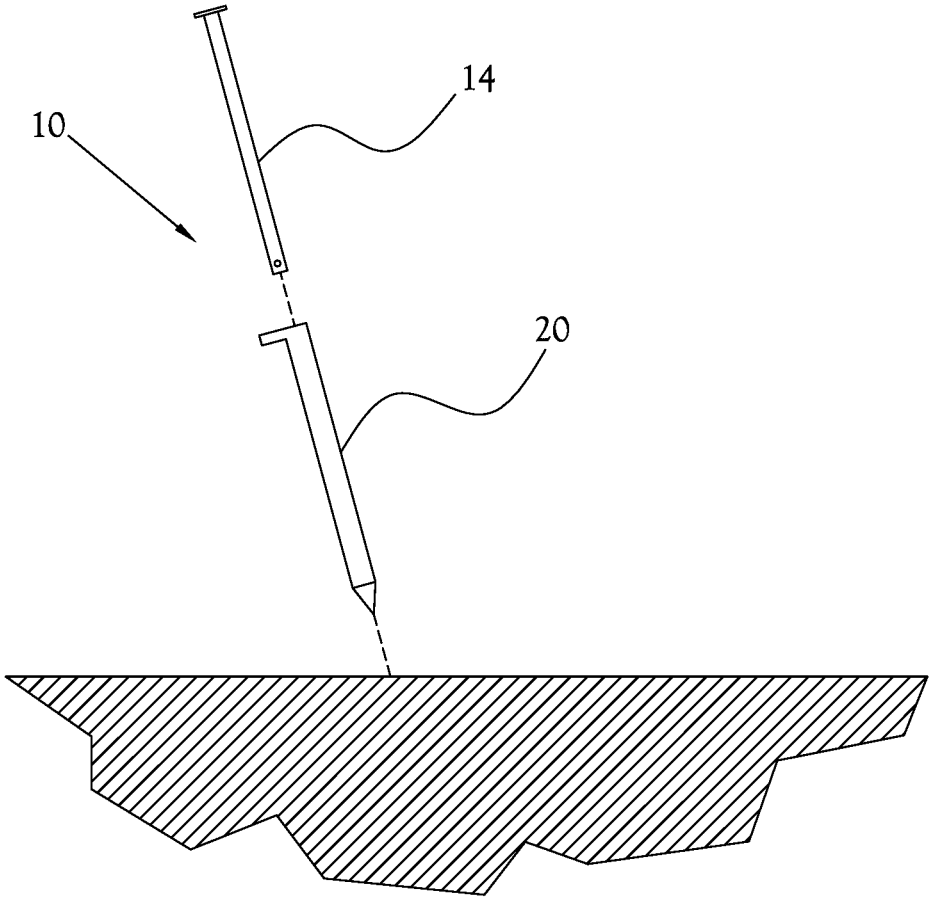
FIG. 5 illustrates a simplified side-view of the locking tent stake of FIG. 1 during an operation of an associated method.
Figure 6:
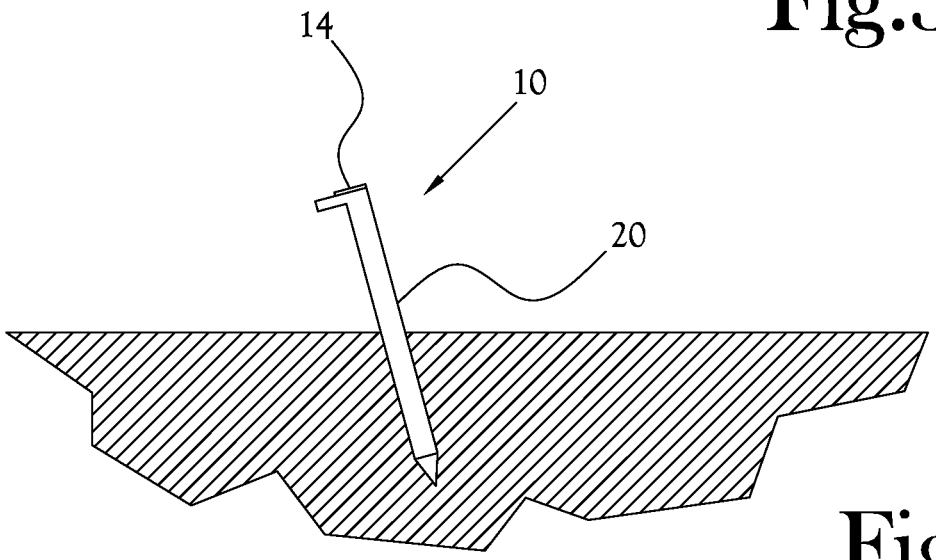
FIG. 6 illustrates a simplified side-view of the locking tent stake of FIG. 1 during another operation of an associated method.
Figure 7:
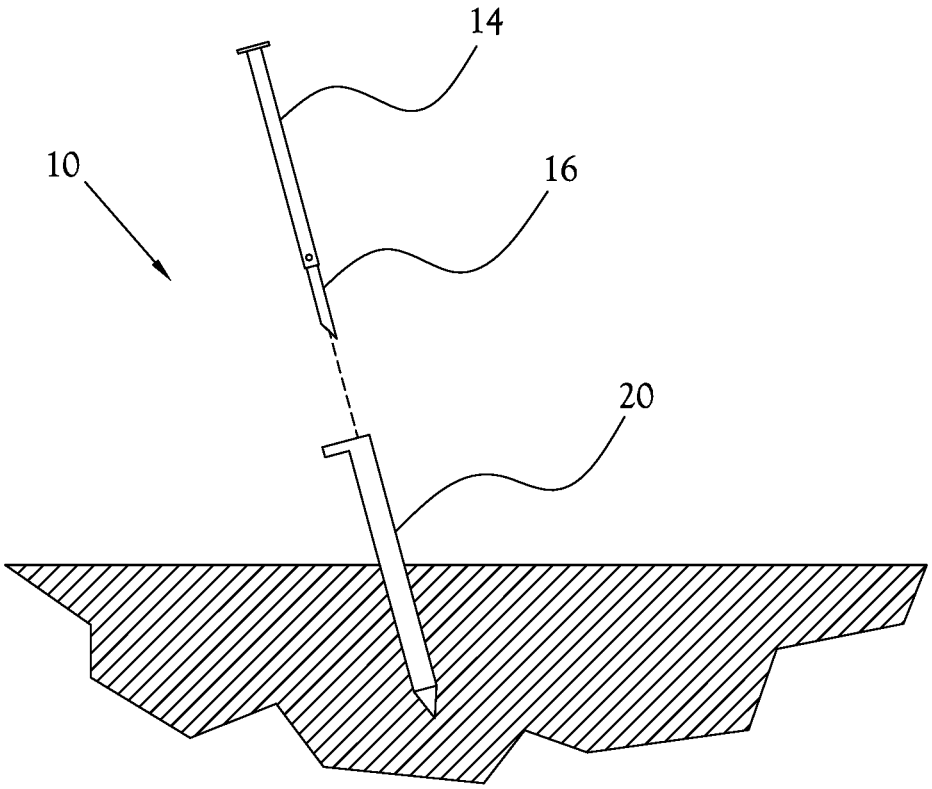
FIG. 7 illustrates a simplified side-view of the locking tent stake of FIG. 1 during another operation of an associated method.
Figure 8:
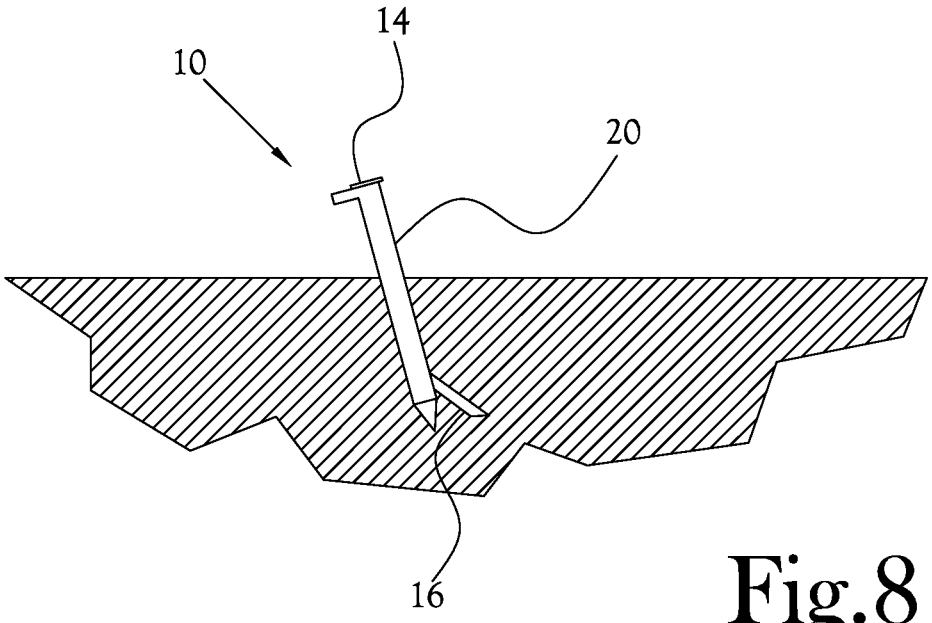
FIG. 8 illustrates a simplified side-view of the locking tent stake of FIG. 1 during another operation of an associated method.

FIG. 5 illustrates a simplified side-view of the locking tent stake 10 of FIG. 1 during an operation of an associated method of deploying the tent stake 10. As illustrated in FIG. 5, before the tent stake 10 is driven into the ground, the central pin 14 may first be received within the sleeve 12, with the retractable barb 16 rotated back so as to be received within the slotted recess 50 of the central pin. FIG. 6 illustrates a simplified side-view of the locking tent stake 10 during another operation of the associated method, in which the combined pin 14 and sleeve 12 may be driven into a surface, such as for example the ground, by using a hammer or other such applied force on the rearward flange 44 of the assembled tent stake 10. FIG. 7 illustrates a simplified side-view of the locking tent stake 10 during another operation of the associated method, in which the central pin 14 is removed from the sleeve interior 34, at which point the barb 16 may then be rotated in relationship to the shaft 40, such that the barb 16 is extended forward of the shaft 40 with the barb 16 in parallel, coaxial relationship with the shaft 40. Thereafter, as illustrated in FIG. 8 which shows a simplified side-view of still another operation of the associated method, the pin 14 with the extended barb 16 may be re-inserted into the interior 34 of the sleeve 12, thereby driving the barb 16 outward from the slot 18 and into the ground surface. As illustrated in FIG. 8, once the barb 16 is thus deployed, the barb 16 serves to discourage removal of the stake 10 from the ground surface.

In various example embodiments of the present general inventive concept, a host of different configurations and features may be provided to enable proper orientation of the pin 14 in relation to the sleeve 12, such that insertion of the shaft 40 into the sleeve interior 34 is limited to orientations in which the slotted recess 50 and corresponding barb 16 are aligned in underlying relationship with the through slot 18 of the outer sleeve 12. For example, in various example embodiments, the interior 34 of the sleeve 12 may define an irregular cross-sectional shape, such as for example a key-hole shape, perpendicular to the axial dimension of the sleeve 12. In various embodiments, the shaft 40 of the pin 14 may define a cross-sectional shape which is keyed to the cross-sectional shape of the sleeve interior 34, such that receipt of the pin 14 within the sleeve 12 is limited to a single orientation, that is, with the recess 50 and corresponding barb 16 aligned in underlying relationship with the through slot 18 of the outer sleeve 12. In various other example embodiments, the recess 50 and barb 16 may be slightly longer than the through slot 18, such that, when the pin 14 is received within the sleeve interior 34 with the barb 16 retracted within the recess 50, rotation of the barb 16 outward through the slot 18 is prevented.

Figure 9C:
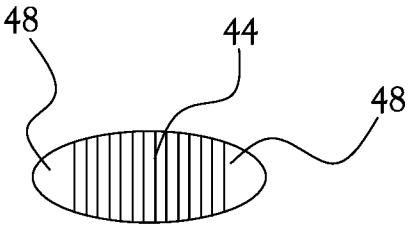
FIGS. 9A-D illustrate various top, front, and different side views of the central pin of FIG. 1 according to an example embodiment of the present general inventive concept.
Figure 9D:
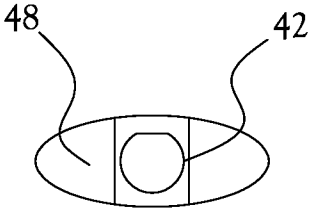
Figure 9B:
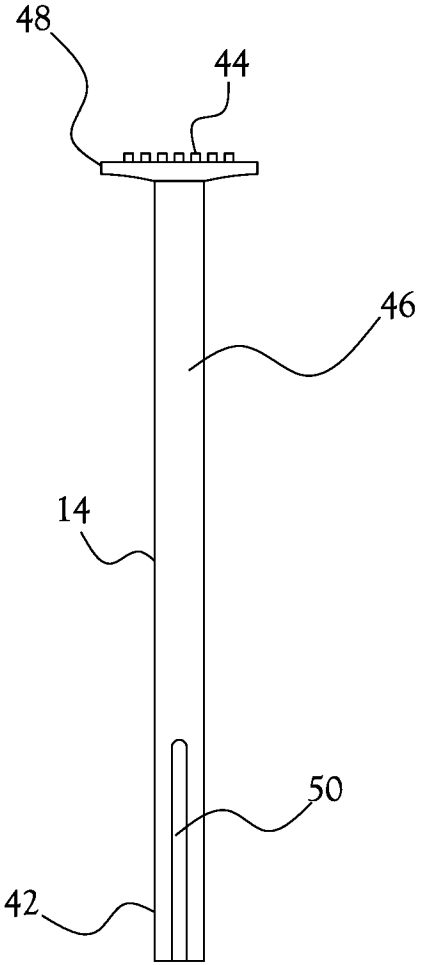
Figure 9A:
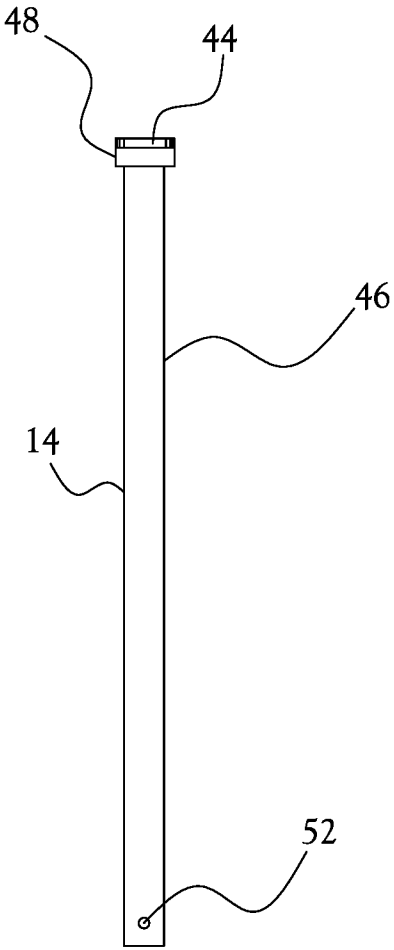

FIGS. 9A-D illustrate various top, front, and different side views of the central pin 14 of FIG. 1 according to an example embodiment of the present general inventive concept. FIG. 9A illustrates a side view of the central pin 14 in which the pin connector 52 is substantially parallel with the orientation of the rearward flange 44, and FIG. 9B illustrates a side view with the central pin 14 of FIG. 9A rotated 90 degrees (the retractable barb 16 and pin connector 52 are omitted for the sake of clarity). FIGS. 9C-D respectively illustrate top and bottom side views of the central pin 14.

Figure 10C:
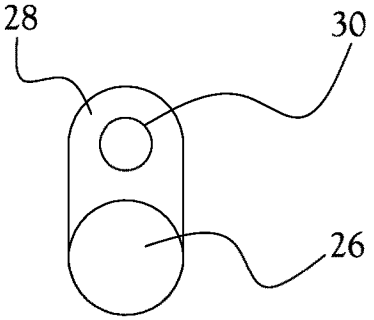
FIGS. 10A-C illustrate side, top, and bottom views of the elongate outer sleeve of FIG. 1 according to an example embodiment of the present general inventive concept.
Figure 10B:
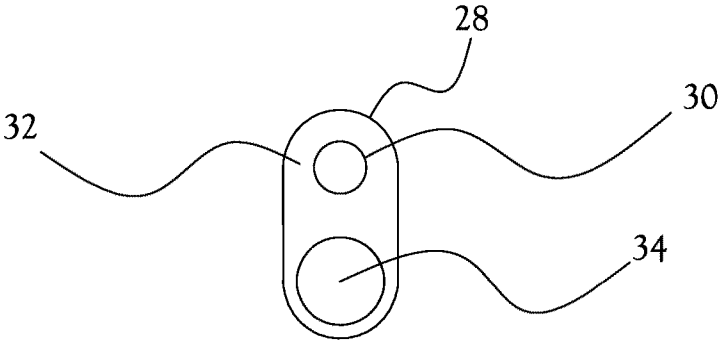
Figure 11:
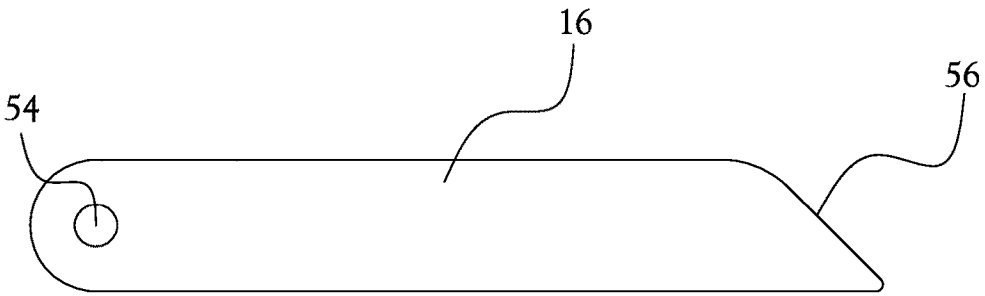
FIG. 11 illustrates a side view of the retractable barb of FIG. 1 according to an example embodiment of the present general inventive concept.
Figure 10A:
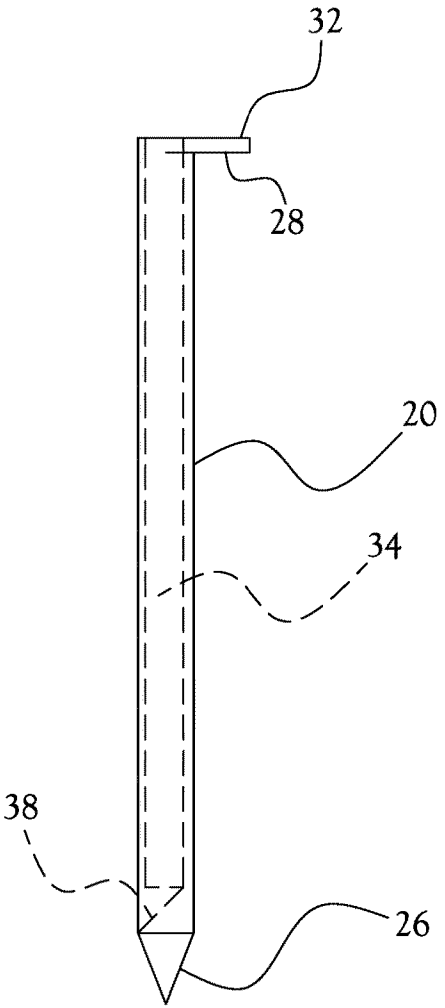

FIGS. 10A-C illustrate side, top, and bottom views of the elongate outer sleeve 12 of FIG. 1 according to an example embodiment of the present general inventive concept. FIG. 11 illustrates a side view of the retractable barb 16 of FIG. 1 according to an example embodiment of the present general inventive concept. As illustrated in FIG. 11, the retractable barb 16 has a pin connector opening 54 formed at a first end to receive the pin connector 52 of the central pin 14, and a tapered end 56 formed at a second end to facilitate movement outward through the through slot 18 of the outer sleeve 12 when the tapered end 56 contacts the ramp surface 38 of the outer sleeve 12. In various example embodiments the tapered end 56 may be formed with a different angle than the ramp surface 38 so that the distal point contacts the ramp surface 38 first. In other various example embodiments the second end of the barb 16 may have an arcuate shape to maintain a smooth contact with the ramp surface 38 during a the deployment of the barb 16 outside the outer sleeve 12.

Figure 12:
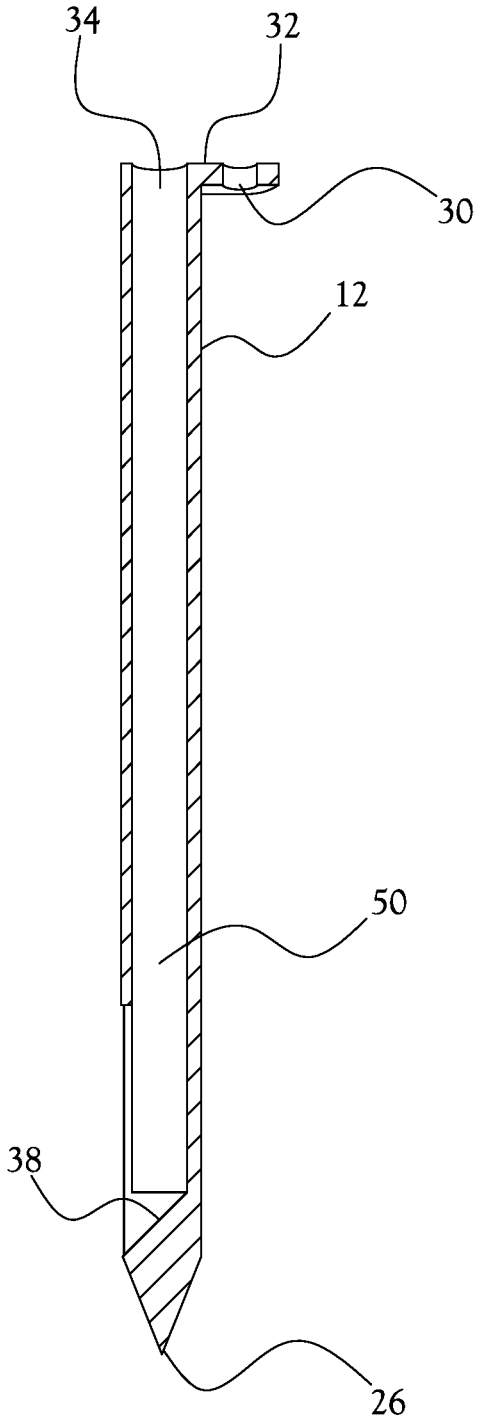
FIGS. 12-15 illustrate cross-sectional views of the locking tent stake of FIG. 1 during a method of operating the locking tent stake according to an example embodiment of the present general inventive concept.
Figure 13:
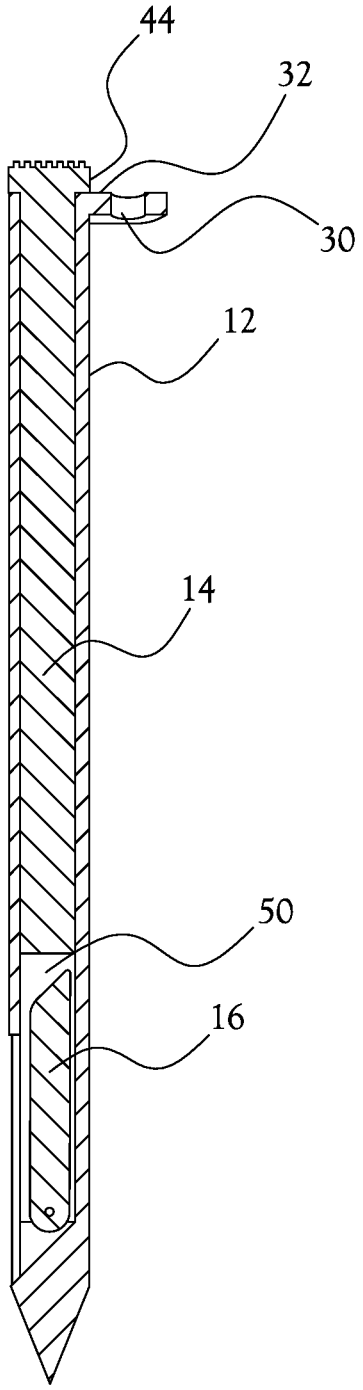
Figure 14:
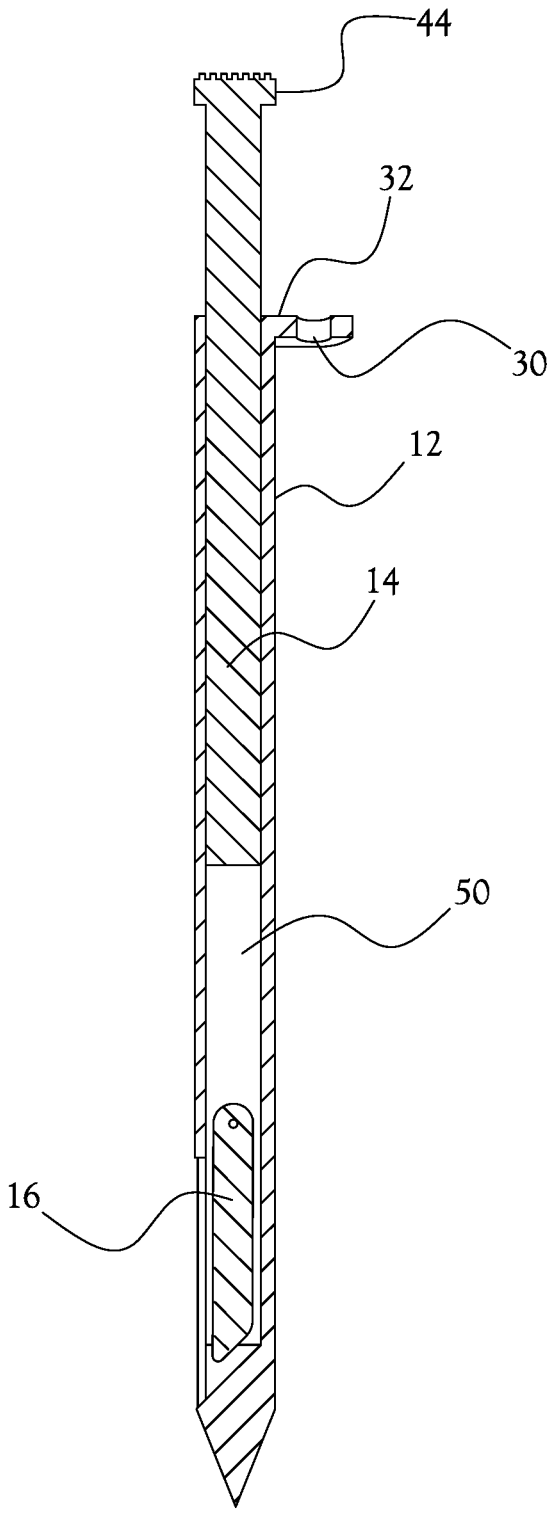
Figure 15:
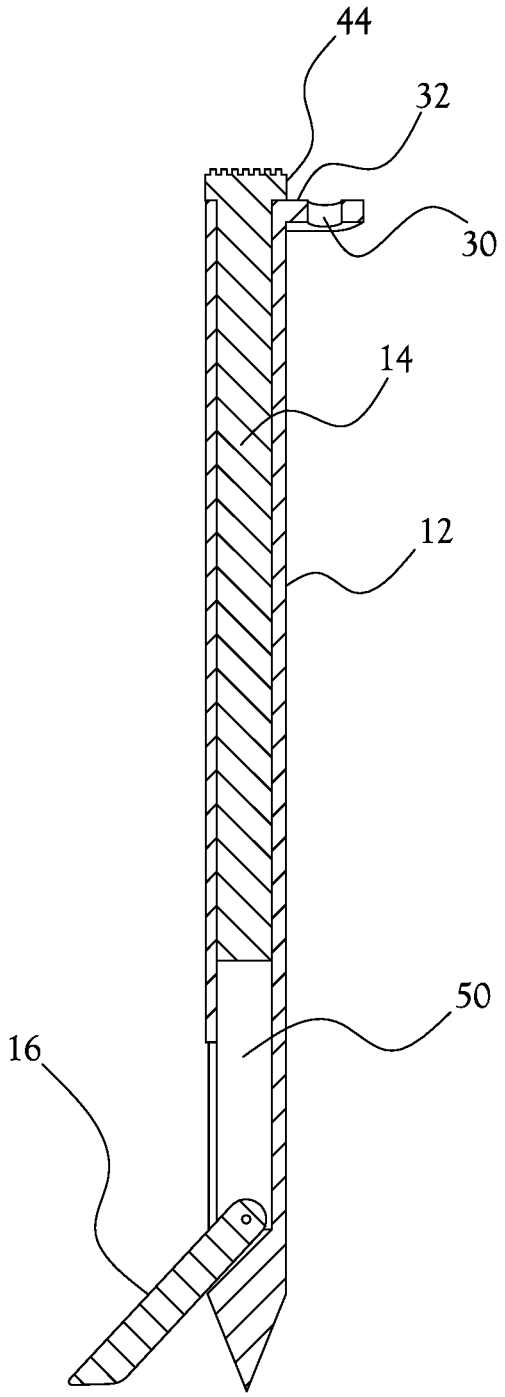

FIGS. 12-15 illustrate cross-sectional views of the locking tent stake 10 of FIG. 1 during a method of operating the locking tent stake 10 according to an example embodiment of the present general inventive concept. As illustrated in FIG. 12, in an initial operation the elongate outer shaft may not have the central pin 14 inserted therein. A user may rotate the retractable barb 16 so as to be received in the slotted recess 50 such that the retractable barb is wholly contained within the central pin 14, and then insert the central pin 14 into the outer sleeve 12 as illustrated in FIG. 13. After driving the tent stake 10 into the ground, the user may then pull the central pin 14 out of the outer sleeve 12, rotate the retractable barb 16 out to point forward from the forward portion 42 of the central pin 14, and then insert the central pin 14, retractable barb 16 first, back into the interior 34 of the outer sleeve 12. As illustrated in FIG. 14, as the central pin 14 is inserted into the interior 34 of the outer sleeve 12, the distal end of the retractable barb 16 will eventually contact the ramp surface 38 of the interior 34, at which point the barb will be urged outward through the through slot 18 of the outer sleeve 12 as the central pin 14 is pushed fully into the outer sleeve 12, as illustrated in FIG. 15.

Figure 16A:
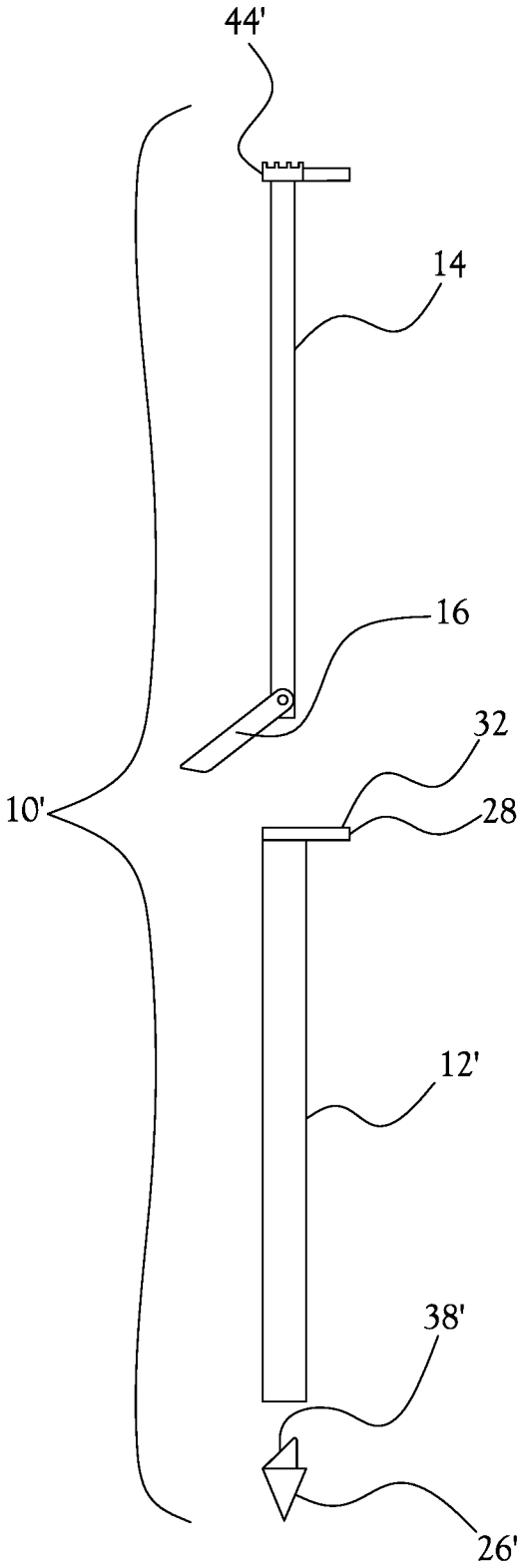
FIGS. 16A-C illustrate various views of a locking tent stake according to another example embodiment of the present general inventive concept.
Figure 16B:
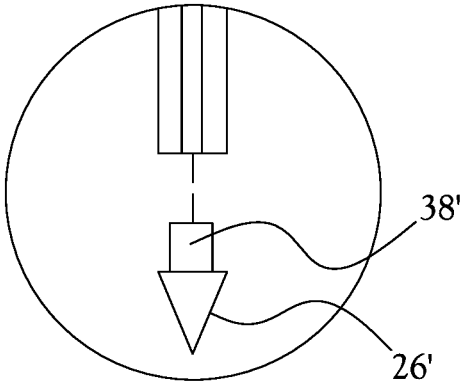
Figure 16C:
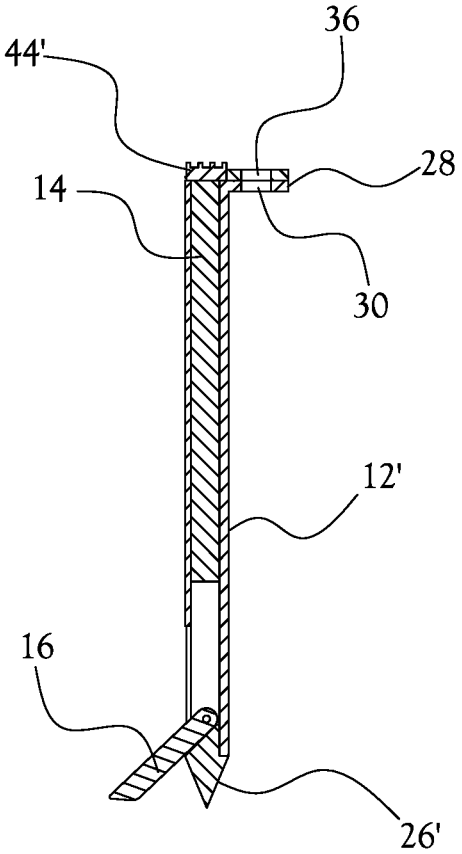

FIGS. 16A-C illustrate various views of a locking tent stake according to another example embodiment of the present general inventive concept. In the example embodiment illustrated in FIGS. 16A-C, a locking tent stake 10' has many of the same components as the tent stake 10 of FIG. 1, including the central pin 14 with the retractable pin 16. However, the hollow elongate interior of the outer sleeve 12' runs through the bottom end of the outer sleeve 12', and a ramp surface 38' is formed integrally with a point member 26' that is formed separately from the outer sleeve 12'. The point member 26' may be joined to the bottom of the outer sleeve 12' in a number of ways, such as being welded or otherwise adhered thereto, or by a threading (not shown) that allows the point member 26' to be connected to the outer sleeve 12'. In example embodiments in which the point member 26'36' is formed to be selectively removed from the outer sleeve 12' (e.g., a threaded connection, a friction fit, an adhering member such as a screw, etc.), different point members 26'36' may be interchangeable to allow for a sharper point, a differently angled point, or differently angled ramp surfaces 38' as desired by a user. As illustrated in FIG. 16C, once the point member 26' is connected to the bottom (forward) end of the outer sleeve 12, the ramp surface 38' is disposed inside the hollow shaft of the outer sleeve 12 and operates to guide the retractable barb 16 out of the outer sleeve 12 in the same manner as described in relation to FIG. 1. In this example embodiment, the flange 44' is also formed to define the previously described through opening 36 that is configured to overlie the through opening 30 of the flange 28 of the sleeve 12'.

Various example embodiments of the present general inventive concept may provide a locking tent stake including an elongate sleeve defining a hollow interior, an opening at a rearward end of the sleeve, and a slot extending along an axial dimension of a forward portion of the sleeve, the slot providing external access to a forward end of the interior of the sleeve, and a pin configured to be receivable within the rearward opening along a length of the interior of the sleeve, the pin comprising an elongate shaft having a retractable barb rotatably secured to a forward end thereof, the barb being rotatable between a first position, in which the barb is received within a recess along the length of the shaft, and a second position, in which the barb is extended forward of the forward end of the shaft, wherein when the barb is extended forward of the forward end of the shaft and the shaft is inserted along the interior of the sleeve, the barb is urged outward from the sleeve interior through the slot. At least a portion of the sleeve interior may define an irregular cross-sectional shape, and wherein at least a portion of the shaft is keyed to the irregular cross-sectional shape defined by the sleeve interior. A forward surface of the slot and a forward surface of the sleeve interior may cooperate to define a ramp surface extending outwardly and forwardly form the sleeve interior. The pin may further define a first flange extending outwardly from a rearward end of the shaft, perpendicular to an axial dimension of the shaft. The sleeve may further define a second flange extending outwardly from a rearward end of the sleeve, perpendicular to an axial dimension of the sleeve, wherein the opening is defined by the second flange. The second flange may define a first through opening configured to allow a rope to be received therethrough. The first flange may define a second through opening configured to overlie the first through opening and cooperate therewith to allow a rope to be received therethrough.

Various example embodiments of the present general inventive concept may provide a locking tent stake including a first elongate member configured with a pointed first end, a hollow shaft extending from an opening formed in a second end, and a through slot formed in an exterior of the first elongate member proximate the first end, a second elongate member configured to be selectively inserted into, and removed from, the hollow shaft of the first elongate member, a retractable barb pivotally coupled to a first end of the second elongate member and configured to be selectively rotated between a back position retracted into the second elongate member and a forward position extending away from the first end of the second elongate member, wherein the retractable barb is guided through the through slot of the first elongate member when the second elongate member is inserted into the second elongate member with the retractable barb extended to the forward position. The locking tent stake may further include a ramp surface formed at a bottom of the hollow shaft of the first elongate member, and configured to lead downward toward the through slot to guide the retractable barb out of the through slot during insertion of the second elongate member into the first elongate member. The pointed first end may be formed separately from the first elongate member and is configured to be connectable thereto. The ramp surface may be formed integrally with the pointed first end. The locking tent stake may further include a slotted recess formed proximate the first end of the second elongate member and configured to receive the retractable barb in the back position. The locking tent stake may further include a first flange provided at a second end of the second elongate member and configured to abut a second end of the first elongate member. The locking tent stake may further include a second flange provided at a second end of the first elongate member, and configured with a through hole to receive a tent securing member. The locking tent stake may further include another through hole formed in the first flange to correspond to the through hole formed in the second flange. The retractable barb may have a tapered leading end configured to contact at least a portion of the ramp surface as the retractable barb is being guided through the through slot of the first elongate member. The retractable barb may have an arcuate leading end configured to contact at least a portion of the ramp surface as the retractable barb is being guided through the through slot of the first elongate member.

Various example embodiments of the present general inventive concept may provide a method of establishing a secure connection with a ground surface, the method including providing an elongate sleeve defining a hollow interior, an opening at a rearward end of the sleeve, and a slot extending along an axial dimension of a forward portion of the sleeve, the slot providing external access to a forward end of the interior of the sleeve, providing a pin receivable within the rearward opening along a length of the interior of the sleeve, the pin comprising an elongate shaft having a retractable barb rotatably secured to a forward end thereof, the barb being rotatable between a first position, in which the barb is received within a recess along the length of the shaft, and a second position, in which the barb is extended forward of the forward end of the shaft, inserting the pin into the sleeve interior with the barb in the first position, driving the pin and sleeve into the ground surface, removing the pin from the sleeve and rotating the barb to the second position, and re-inserting the pin into the sleeve interior, whereby the barb is urged outward from the sleeve interior through the slot.

Numerous variations, modifications, and additional embodiments are possible, and accordingly, all such variations, modifications, and embodiments are to be regarded as being within the spirit and scope of the present general inventive concept. For example, regardless of the content of any portion of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated.

It is noted that the simplified diagrams and drawings included in the present application do not illustrate all the various connections and assemblies of the various components, however, those skilled in the art will understand how to implement such connections and assemblies, based on the illustrated components, figures, and descriptions provided herein, using sound engineering judgment. Numerous variations, modification, and additional embodiments are possible, and, accordingly, all such variations, modifications, and embodiments are to be regarded as being within the spirit and scope of the present general inventive concept.

While the present general inventive concept has been illustrated by description of several example embodiments, and while the illustrative embodiments have been described in detail, it is not the intention of the applicant to restrict or in any way limit the scope of the general inventive concept to such descriptions and illustrations. Instead, the descriptions, drawings, and claims herein are to be regarded as illustrative in nature, and not as restrictive, and additional embodiments will readily appear to those skilled in the art upon reading the above description and drawings. Additional modifications will readily appear to those skilled in the art. Accordingly, departures may be made from such details without departing from the spirit or scope of applicant's general inventive concept.

The invention claimed is:

1. A locking tent stake, comprising:

an elongate sleeve defining a hollow interior, an opening at a rearward end of the sleeve, and a slot extending along an axial dimension of a forward portion of the sleeve, the slot providing external access to a forward end of the interior of the sleeve; and a pin configured to be receivable within the rearward opening along a length of the interior of the sleeve, the pin comprising an elongate shaft having a retractable barb rotatably secured to a forward end thereof, the barb being rotatable between a first position, in which the barb is rotated back from the forward end of the shaft so as to be received within a recess along the length of the shaft, and a second position, in which the barb is extended forward of the forward end of the shaft;

wherein when the barb is extended forward of the forward end of the shaft and the shaft is inserted along the interior of the sleeve, the barb is urged outward from the sleeve interior through the slot.

2. The locking tent stake of claim 1, wherein at least a portion of the sleeve interior defines an irregular cross-sectional shape, and wherein at least a portion of the shaft is keyed to the irregular cross-sectional shape defined by the sleeve interior.

3. The locking tent stake of claim 2, wherein a forward surface of the slot and a forward surface of the sleeve interior cooperate to define a ramp surface extending outwardly and forwardly form the sleeve interior.

4. The locking tent stake of claim 3, wherein the pin further defines a first flange extending outwardly from a rearward end of the shaft, perpendicular to an axial dimension of the shaft.

5. The locking tent stake of claim 4, wherein the sleeve further defines a second flange extending outwardly from a rearward end of the sleeve, perpendicular to an axial dimension of the sleeve.

6. The locking tent stake of claim 5, wherein the second flange defines a first through opening configured to allow a rope to be received therethrough.

7. The locking tent stake of claim 6, wherein the first flange defines a second through opening configured to overlie the first through opening and cooperate therewith to allow a rope to be received therethrough.

8. A locking tent stake, comprising:

a first elongate member configured with a pointed first end, a hollow shaft extending from an opening formed in a second end, and a through slot formed in an exterior of the first elongate member proximate the pointed first end;

a second elongate member configured to be selectively inserted into, and removed from, the hollow shaft of the first elongate member;

a retractable barb pivotally coupled to a first end of the second elongate member and configured to be selectively rotated between a back position retracted into the second elongate member extending backward from where the barb is pivotally coupled to the first end of the second elongate member, and a forward position extending away from the first end of the second elongate member;

wherein the retractable barb is guided through the through slot of the first elongate member when the second elongate member is inserted into the first elongate member with the retractable barb extended to the forward position.

9. The locking tent stake of claim 8, further comprising a ramp surface formed at a bottom of the hollow shaft of the first elongate member, and configured to lead downward toward the through slot to guide the retractable barb out of the through slot during insertion of the second elongate member into the first elongate member.

10. The locking tent stake of claim 9, wherein the pointed first end is formed separately from the first elongate member and is configured to be connectable thereto.

11. The locking tent stake of claim 10, wherein the ramp surface is formed integrally with the pointed first end.

12. The locking tent stake of claim 9, wherein the retractable barb has a tapered leading end configured to contact at least a portion of the ramp surface as the retractable barb is being guided through the through slot of the first elongate member.

13. The locking tent stake of claim 9, wherein the retractable barb has an arcuate leading end configured to contact at least a portion of the ramp surface as the retractable barb is being guided through the through slot of the first elongate member.

14. The locking tent stake of claim 8, further comprising a slotted recess formed proximate the first end of the second elongate member and configured to receive the retractable barb in the back position.

15. The locking tent stake of claim 8, further comprising a first flange provided at a second end of the second elongate member and configured to abut the second end of the first elongate member.

16. The locking tent stake of claim 15, further comprising a second flange provided at the second end of the first elongate member, and configured with a through hole to receive a tent securing member.

17. The locking tent stake of claim 16, further comprising another through hole formed in the first flange to correspond to the through hole formed in the second flange.

18. A method of establishing a secure connection with a ground surface, the method comprising:

providing an elongate sleeve defining a hollow interior, an opening at a rearward end of the sleeve, and a slot extending along an axial dimension of a forward portion of the sleeve, the slot providing external access to a forward end of the interior of the sleeve;

providing a pin receivable within the rearward opening along a length of the interior of the sleeve, the pin comprising an elongate shaft having a retractable barb rotatably secured to a forward end thereof, the barb being rotatable between a first position, in which the barb is received within a recess along the length of the shaft, and a second position, in which the barb is extended forward of the forward end of the shaft;

inserting the pin into the sleeve interior with the barb in the first position;

driving the pin and sleeve into the ground surface;

removing the pin from the sleeve and rotating the barb to the second position; and re-inserting the pin into the sleeve interior, whereby the barb is urged outward from the sleeve interior through the slot.

19. A locking tent stake, comprising:

an elongate sleeve defining a hollow interior, an opening at a rearward end of the sleeve, and a slot extending along an axial dimension of a forward portion of the sleeve, the slot providing external access to a forward end of the interior of the sleeve; and a pin configured to be receivable within the rearward opening along a length of the interior of the sleeve, the pin comprising an elongate shaft having a retractable barb rotatably secured to a forward end thereof, the barb being rotatable between a first position, in which the barb is received within a recess along the length of the shaft, and a second position, in which the barb is extended forward of the forward end of the shaft;

wherein when the barb is extended forward of the forward end of the shaft and the shaft is inserted along the interior of the sleeve, the barb is urged outward from the sleeve interior through the slot, wherein the pin further defines a first flange extending outwardly from a rearward end of the shaft, perpendicular to an axial dimension of the shaft, wherein the sleeve further defines a second flange extending outwardly from a rearward end of the sleeve, perpendicular to an axial dimension of the sleeve, and wherein the second flange defines a first through opening configured to allow a rope to be received therethrough.

20. A locking tent stake, comprising:

a first elongate member configured with a pointed first end, a hollow shaft extending from an opening formed in a second end, and a through slot formed in an exterior of the first elongate member proximate the pointed first end;

a second elongate member configured to be selectively inserted into, and removed from, the hollow shaft of the first elongate member;

a retractable barb pivotally coupled to a first end of the second elongate member and configured to be selectively rotated between a back position retracted into the second elongate member and a forward position extending away from the first end of the second elongate member;

a first flange provided at a second end of the second elongate member and configured to abut the second end of the first elongate member; and a second flange provided at the second end of the first elongate member, and configured with a through hole to receive a tent securing member;

wherein the retractable barb is guided through the through slot of the first elongate member when the second elongate member is inserted into the first elongate member with the retractable barb extended to the forward position.

* * * * *